US006162104A

United States Patent [19]

White

[11] Patent Number: 6,162,104

[45] **Date of Patent: *Dec. 19, 2000**

[54] HYDROFOIL PROPELLER GUARD

[76] Inventor: John Forrest White, 800 Windon Ct., Vacaville, Calif. 95688

[ * ] Notice: This patent is subject to a terminal disclaimer.

[21] Appl. No.: 09/372,846

[22] Filed: Aug. 12, 1999

Related U.S. Application Data

[63] Continuation-in-part of application No. 09/111,117, Jul. 6, 1998, Pat. No. 5,975,969, which is a continuation-in-part of application No. 08/822,937, Mar. 21, 1997, abandoned.

[51] Int. Cl.[7] ..... B63H 5/16

[52] U.S. Cl. ..... 440/71; 440/900

[58] Field of Search ..... 440/900, 70–72; 114/145 A, 145 R, 162

[56] References Cited

U.S. PATENT DOCUMENTS

| | | | |
|---|---|---|---|
| 2,551,371 | 5/1951 | Grigg | 440/71 |
| 2,963,000 | 12/1960 | Fester | 440/71 |
| 2,983,246 | 5/1961 | Manley | 440/72 |
| 5,127,353 | 7/1992 | Wieser | 114/145 A |

FOREIGN PATENT DOCUMENTS

| | | | |
|---|---|---|---|
| 2704200 | 10/1994 | France | 440/71 |
| 46998 | 2/1988 | Japan | 440/71 |

*Primary Examiner*—Ed Swinehart

[57] ABSTRACT

A hydrofoil propeller guard, including a thrust tube, a hydrofoil fin and bottom securing plate, is used in conjunction with an outboard motor mounted on a boat and with stern drives, to encompass the propeller to reduce sideways thrust, to move items away from the propeller, and the guard preferably includes a trolling plate to increase slow speed performance.

6 Claims, 7 Drawing Sheets

HYDROFOIL PROPELLER GUARD

CROSS-REFERENCE TO RELATED APPLICATION

This application is a continuation-in-part of copending application Ser. No. 09/111,117, filed Jul. 6, 1998, now U.S. Pat. No. 5,975,969. This application is a continuation-in-part of application Ser. No. 08/822,937, filed Mar. 21, 1997, now abandoned.

BACKGROUND OF THE INVENTION

1. Field of the Invention

This invention relates to a safety propeller guard to be used in combination with the propeller of boats having a stern engine drive or an outboard motor to provide the propeller with obstacle protection, more power and the boat with additional steerage.

2. Description of the Prior Art

For over 50 years various types of propeller protection devices have been employed by or proposed for the marine industry to try to reduce damage to propellers from objects, reduce damage to fishing lines from propellers and protect swimmers, fish, underwater mammals and plant life from the action of propellers. The devices have been called rings, wire baskets, steel fence shrouds and skag guards.

The devices have not been generally adopted. The major drawback has been reduced performance due to such factors as weight, drag, and early failure due to metal fatigue and increased damage with certain objects. Examples of unsuccessful devices include the 1960 configuration shown in U.S. Pat. No. 2,963,000 to Fester and the 1992 flap configuration shown in U.S. Pat. No. 5,127,353 to Wieser.

OBJECTS OF THE INVENTION

Accordingly, it is an object of this invention to provide a propeller guard which incorporates a number of attributes increasing its effectiveness.

Another object is a guard with a low drag characteristic.

Yet another object is a shield having favorable performance characteristics.

It is a further object of this invention to provide a light weight durable guard.

Other objectives, advantages and novel features of the invention will become apparent to those skilled in the art upon examination of the invention and the accompanying drawings.

SUMMARY OF THE INVENTION

BRIEF DESCRIPTION OF THE FIGURES

The following detailed description, taken in conjunction with the accompanying drawings, illustrates a preferred embodiment of the invention. The drawings are.

DETAILED DESCRIPTION OF A PREFERRED EMBODIMENT

Figure 1:
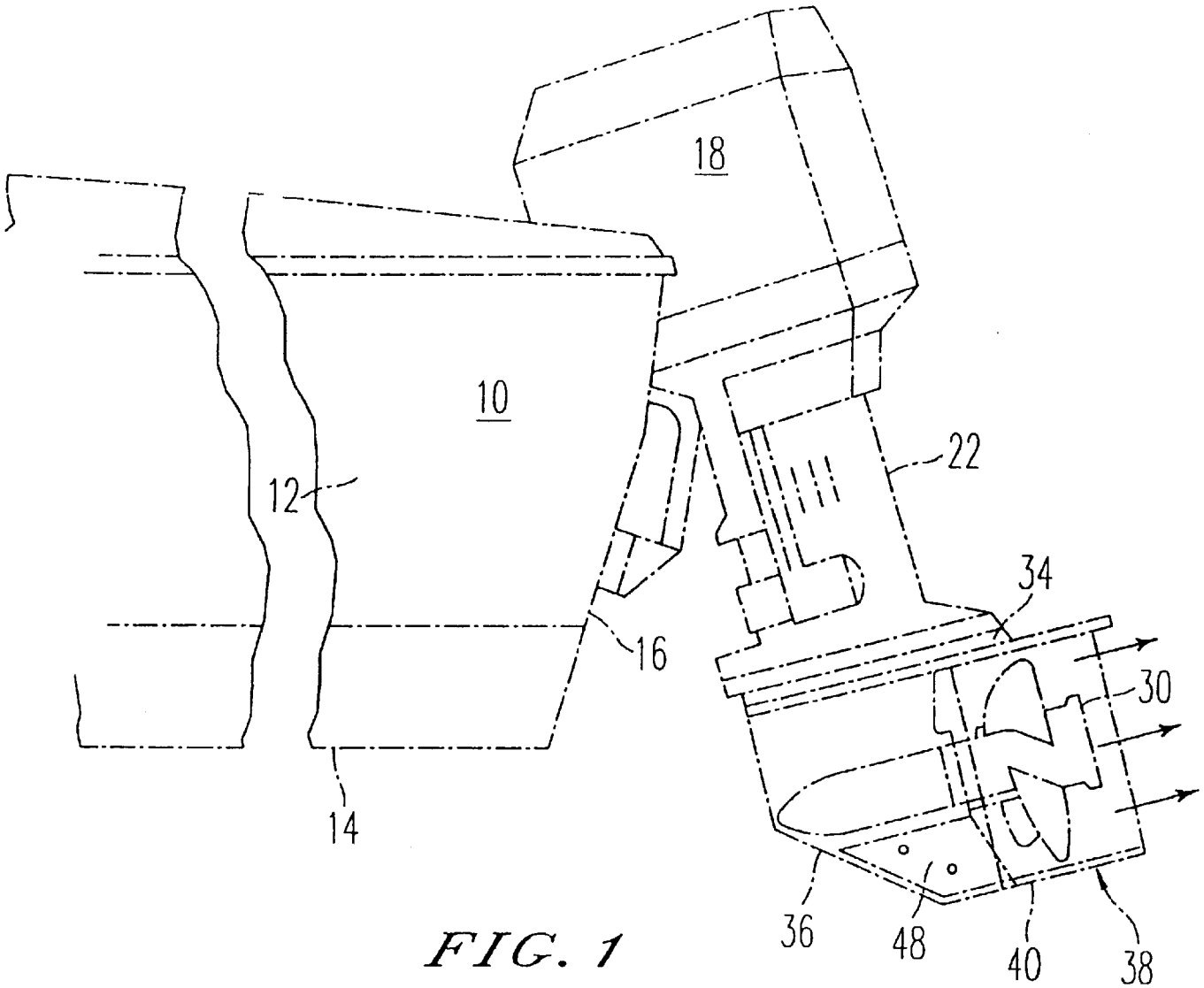
FIG. 1 is a partial side view of a boat having an outboard motor equiped with a hydrofoil propeller guard in accordance with the invention.

As shown in FIG. 1, a typical outboard motor boat 10, includes a hull 12 with a keel 14 and a stern transom 16 to which an outboard motor 18 is attached. The outboard motor 18 includes a driveshaft 20 extending within a driveshaft housing 22 of sufficient length so that a propeller 24 can be mounted to the driveshaft 20 so that the entire propeller 24 is below the surface of the water and below the bottom and keel 14 of the hull 12. Similarly, for boats having an inboard/outboard engine configuration, there is a similar driveshaft extending in a driveshaft housing of sufficient length to have a propeller similarly mounted below the surface of the water.

The propeller 24 includes a hub 30 with multiple propeller blades 32 extending outward from the hub 30. The turning of the propeller 24 by the outboard motor 18 turns the blades 32 which propels the boat 10 through the water by thrushing water rearward and the leading edge of the propeller blades 32 spiraling through the water. As mounted the power of any water thrown sideways is lost.

Typically the driveshaft housing 22 includes an anti-cavitation plate 34 comprising a horizontal surface extending outward about 2 inches from the sides of the driveshaft housing 22. The plate 34 is below the level of the hull 12 and above the upper reach of the propeller blades 32. A portion of the driveshaft housing 22 extends below the low point of the driveshaft 20 and is known as a skeg 36. The skeg provides limited protection to the blades 32 by pushing objects out of the way. The bottom of the skeg 32 typically extends below the bottom reach of the blades 32.

Figure 2:
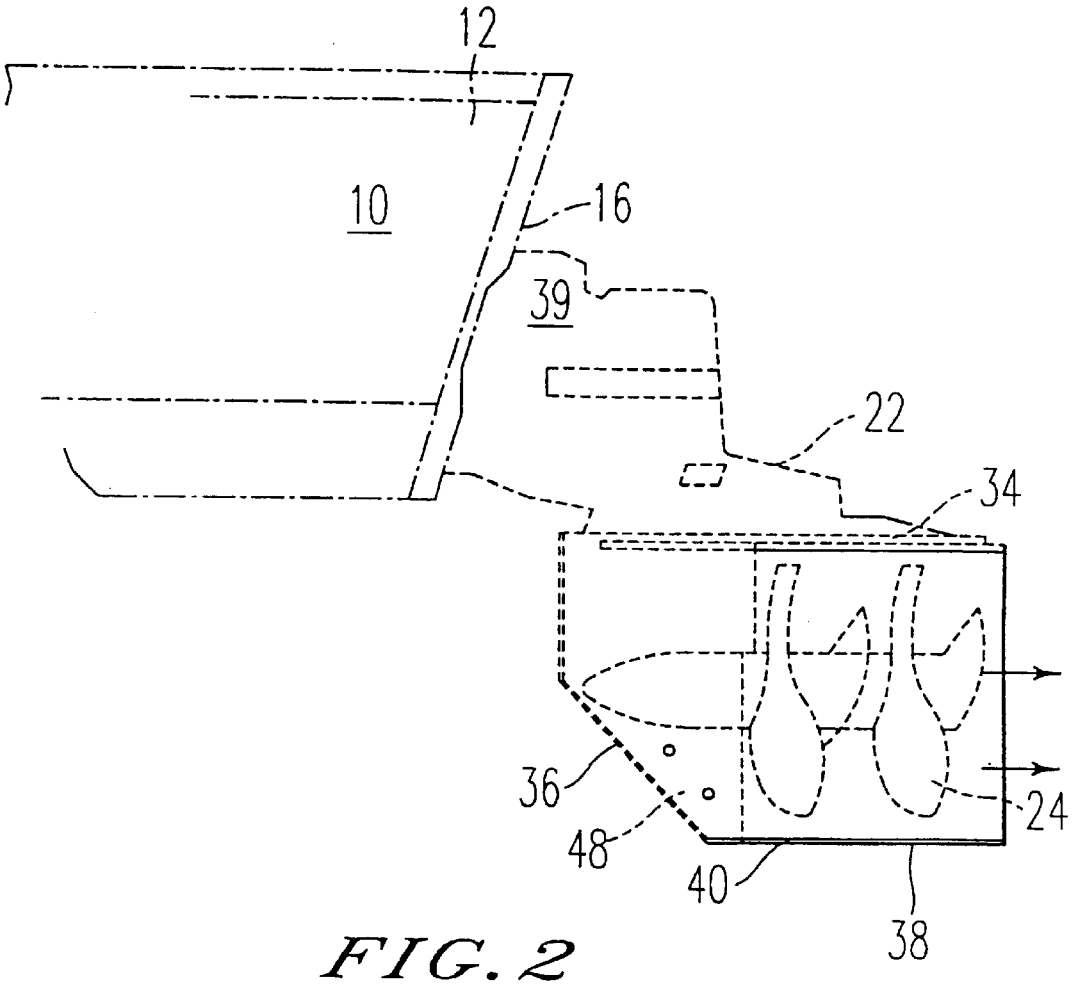
FIG. 2 is a partial side view of a boat with a stern drive equiped with dual in line propellers and with a hydrofoil propeller guard in accordance with the invention.
Figure 3:
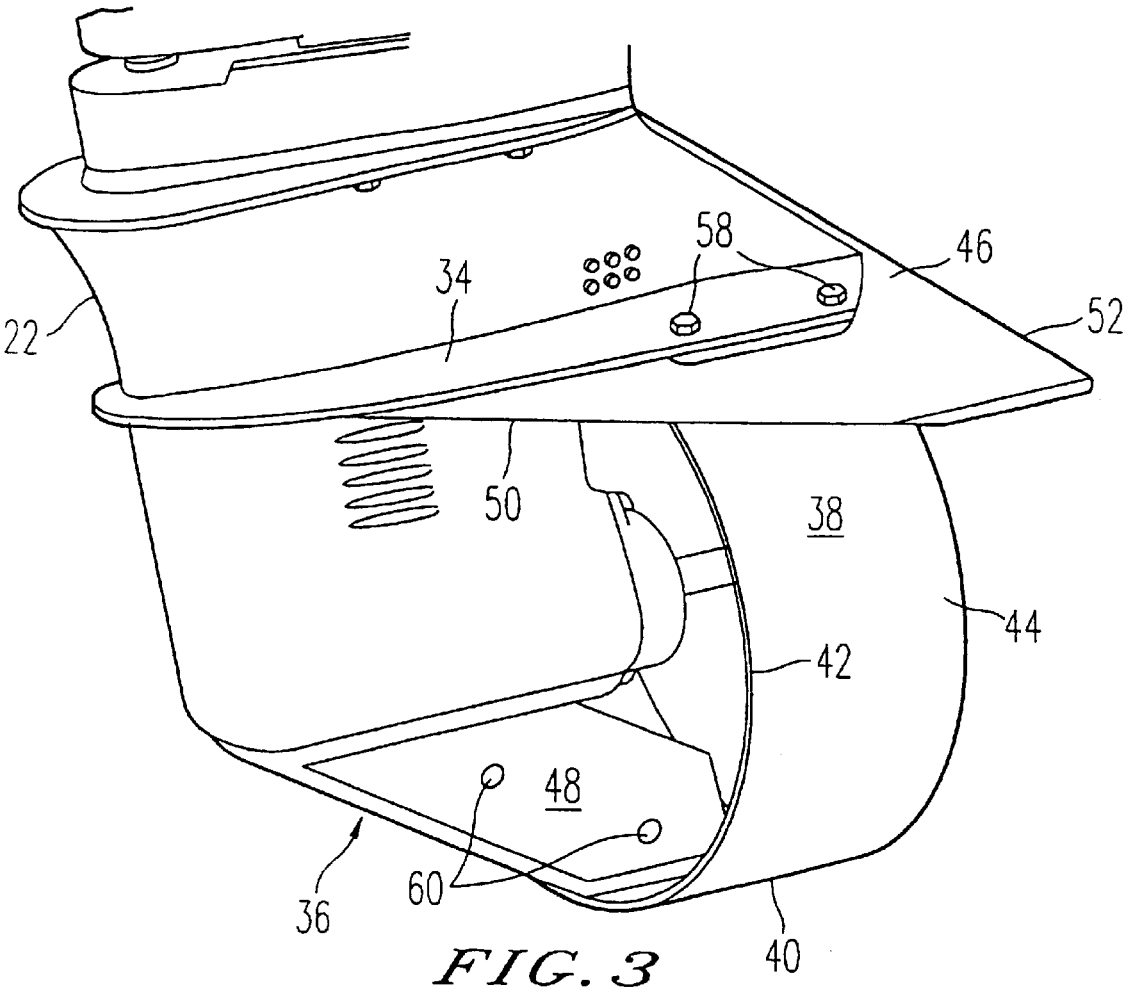
FIG. 3 is a prospective view of an embodiment of the hydrofoil propeller guard according to the present invention mounted to the lower portion of an outboard motor with the propeller removed.
Figure 4:
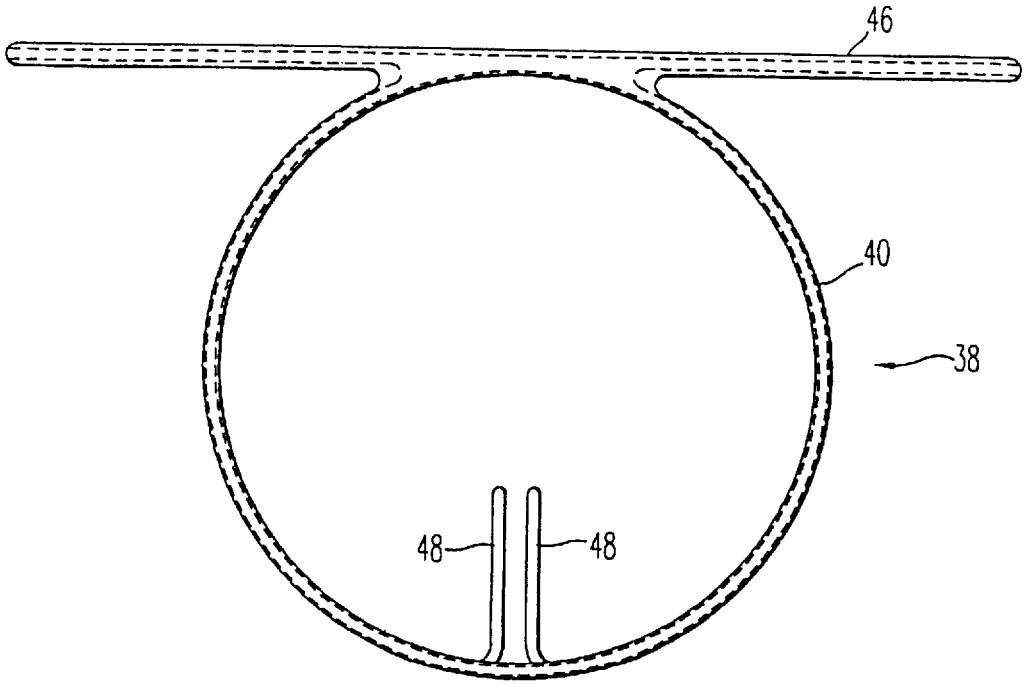
FIG. 4 is a front view of the guard.
Figure 5:
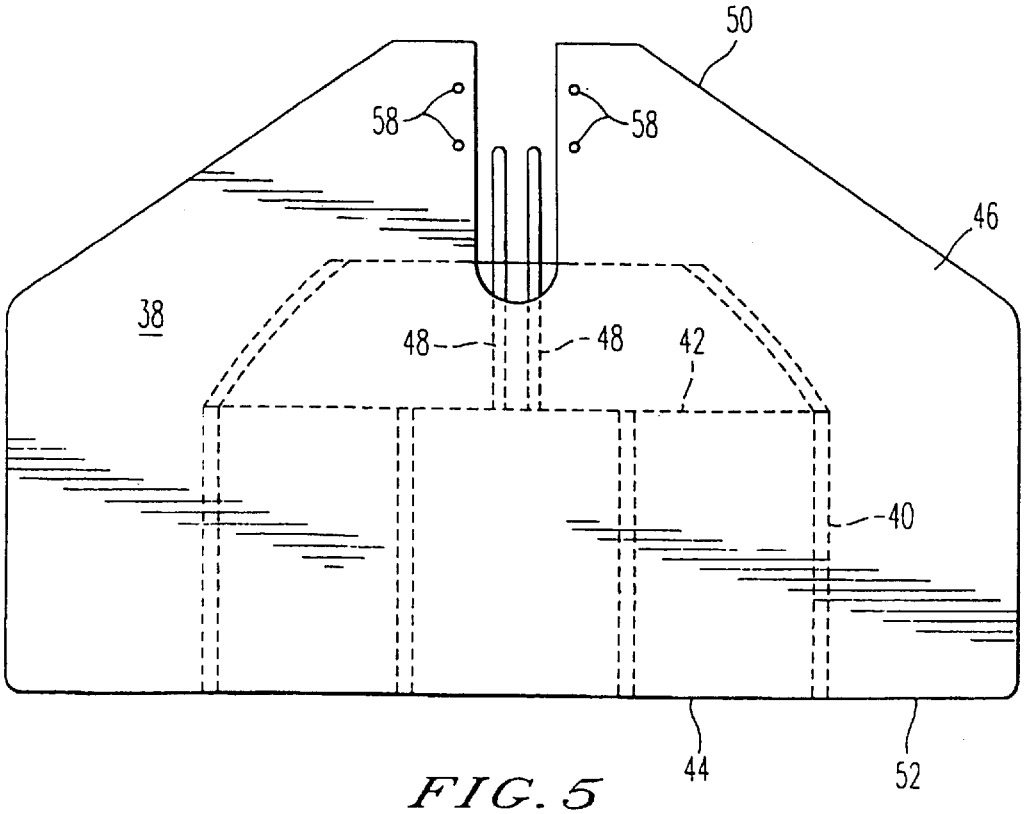
FIG. 5 is a top view of the guard.
Figure 6:
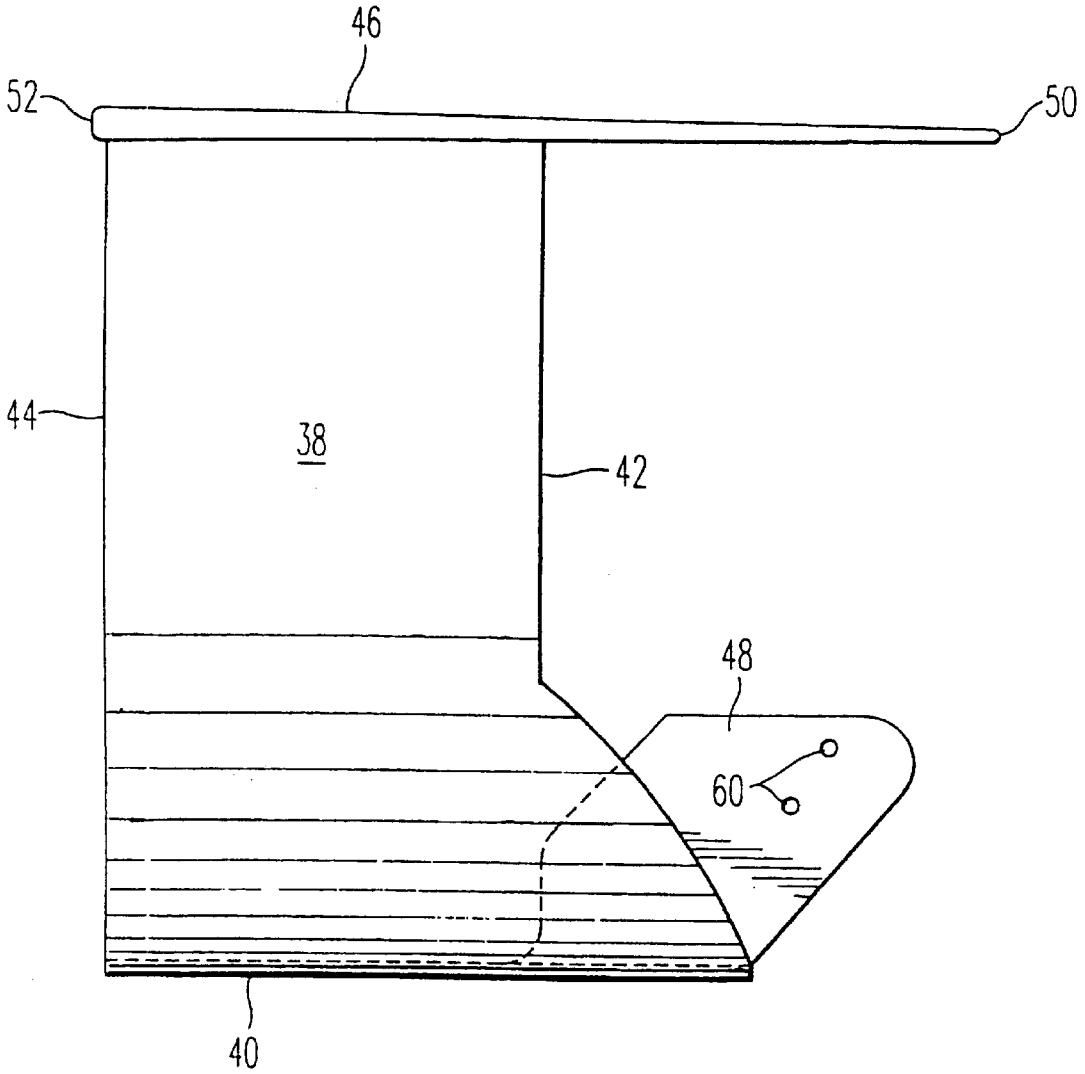
FIG. 6 is a side view of the guard.

A hydrofoil propeller guard 38 in accordance with the invention is shown attached in FIG. 1, attached to a stern drive 39 in FIG. 2 and attached generically in FIG. 3. A typical stern drive 39 is employed with a single propeller 24, but can be employed with two propellers 24 mounted in line on one driveshaft 20. In such a two propeller 24 configuration the length of the guard is doubled but not the width. For purposes of employing the hydrofoil propeller guard 38 there is no real difference between use with an outboard motor 18 or stern drive 39. A stern drive has a comparable anti-cavitation plate 34 and skeg 36.

As shown in more detail in FIGS. 3, 4, 5 and 6, the hydrofoil propeller guard 38 includes a thrust tube 40 which is a tube 40 having an inlet 42 and outlet 44 along a horizontal axis and a length of about twice the length of the hub 30 of the propeller 24, the length being 6 inches for a typical 10 inch diameter propeller 24; a hydrofoil fin 46 attached to or integral to the top of the tube 40 and extending tangentially from the top of the tube 40 outward horizontally; and two securing plates 48 extending spaced apart in parallel, upward from, attached to and integral to a tube extension extending forward at the bottom of the tube 40 about 2.8 inches from an imaginary vertical plane otherwise formed by the edge of the inlet 42 of the tube 40. The securing plates 48 allow the thrust tube 40 significantly back of the leading edge of the skeg 36 and to work in concert with the skeg to better push obstructions down and under the skeg 36 and away from the propeller blades 32. The tube 40 is attached with the securing plates 48 such that the inlet 42 is no more than an inch forward of the leading edge of the propeller blades 32.

The guard 38 can be and is preferably molded as a single piece from plastic in a mold. Such single piece molding simplifies manufacture and improves weight to strength factors by reducing material or joint means such as screws or welds. It also further streamlines the guard to reduce snagging points and crevices conducive to plant growth and deterioration due to material.

The thickness of the tube 40 is generally 3/16 inch adjacent the inlet 42 and thickens at a 1½° taper to ½ inch adjacent the outlet 44. The inside diameter of the tube 40 is about 11 inches which is sufficient to allow the typical 10 inch diameter propeller 24 to rotate within the tube 40. The clearance between the outside edge or tip of the propeller 24 and inside surface of the tube 40 needs to be at least ¼ inch but can be much greater without loss of significant positive effect but preferably is no more than ½ inch.

The hydrofoil fin 46 as seen from above is wing shaped. The wing span is typically 12 inches at the center and tapering to about 6 inches at the tips 52 of the wing span; the thickness of the fin 46 is about 3/16 inch adjacent the front 50 and thickens at a 1½° taper to ½ inch adjacent the tail 52. The tail 52 is aligned with the plane of the outlet 44 so the center of the front of the fin 46 extends about 6 inches forward of inlet 42. The center of the front fin 46 includes an opening 54 in the shape of a "U" about 1.7 inches across with a depth at its maximum of 4.8 inches. This opening 54 is provided so that the guard 38 can be slid forward so the hydrofoil fin 46 encompasses the driveshaft housing 22 adjacent the anti-cavitation plate 34. The hydrofoil fin 46 adjacent the opening 54 includes an attaching means 58 such as holes. Matching holes are drilled in the anti-cavitation plate so that nuts and bolts can be used to attach the guard 38 to the driveshaft housing 22.

The guard 38 measurements will be proportionally larger or smaller in relation to the inside diameter of the tube 40. The tube 40 can be sized to the propeller 24 to be employed. The tube 40 can have an inside diameter of about 17 inches to allow use of up to a 16 inch propeller which will be matched with a fin wing span of 24 inches and tube 40 length of about 9 inches.

The two securing plates 48 are spaced apart about 0.4 inches, extend upward about 3.5 inches, extend front to back about 3 inches and tilt forward to a point about 5 inches forward of the inlet plane. There is also a slight increase in the thickness of plates 48 from front to back 0.19 inches to 0.29 inches. This spaced opening is provided so that the securing plates 48 can be slid forward so the plates 48 encompass the skeg 36. The securing plates 48 include an attaching means 60 such as holes. Matching holes are drilled in the skeg 36 so that ruts and bolts can be used to also attach the guard 38 to the skeg 36 portion of the driveshaft housing 22. The plates 48 improve the function of the skeg 36 in keeping the propeller from hitting bottom objects by tilting the driveshaft upward if such objects are encountered and helping to guide lines and other objects which encounter the skeg away from the propeller.

The impact of attaching the guard 38 to the driveshaft housing 22 is multifold. These impacts have to a significant degree been unappreciated. Attaching that guard 38 to the driveshaft housing 22 at two spaced apart points stabilizes the position of the guard 38 and adds the rigidity of the housing 22 to the guard 38. The enclosing of the propeller 24 in a tube 40 of about 6 ; inches appreciably increases the flow of water in a direction directly behind the propeller 24, or in other words in a direction directly linear thrust is increased and radial thrust is reduced. This increases the ability to steer the boat 10 by the action of the propeller 24 especially at low speeds and in reverse. This effect is little appreciated in the prior art. The tube 40 also reduces wake by reducing side turbulence. The hydrofoil fin 46 also reduces wake by promoting hull planing at lower speeds by inhibiting the bow from rising.

It is desirable to have the fin 46 placed ahead of the tube 40 and be wing like. As such the fin 46 works to push fish lines, cables and down riggers outward and away from the propeller where damage could be done to the propeller blades and the lines, cables or down riggers.

Figure 7:
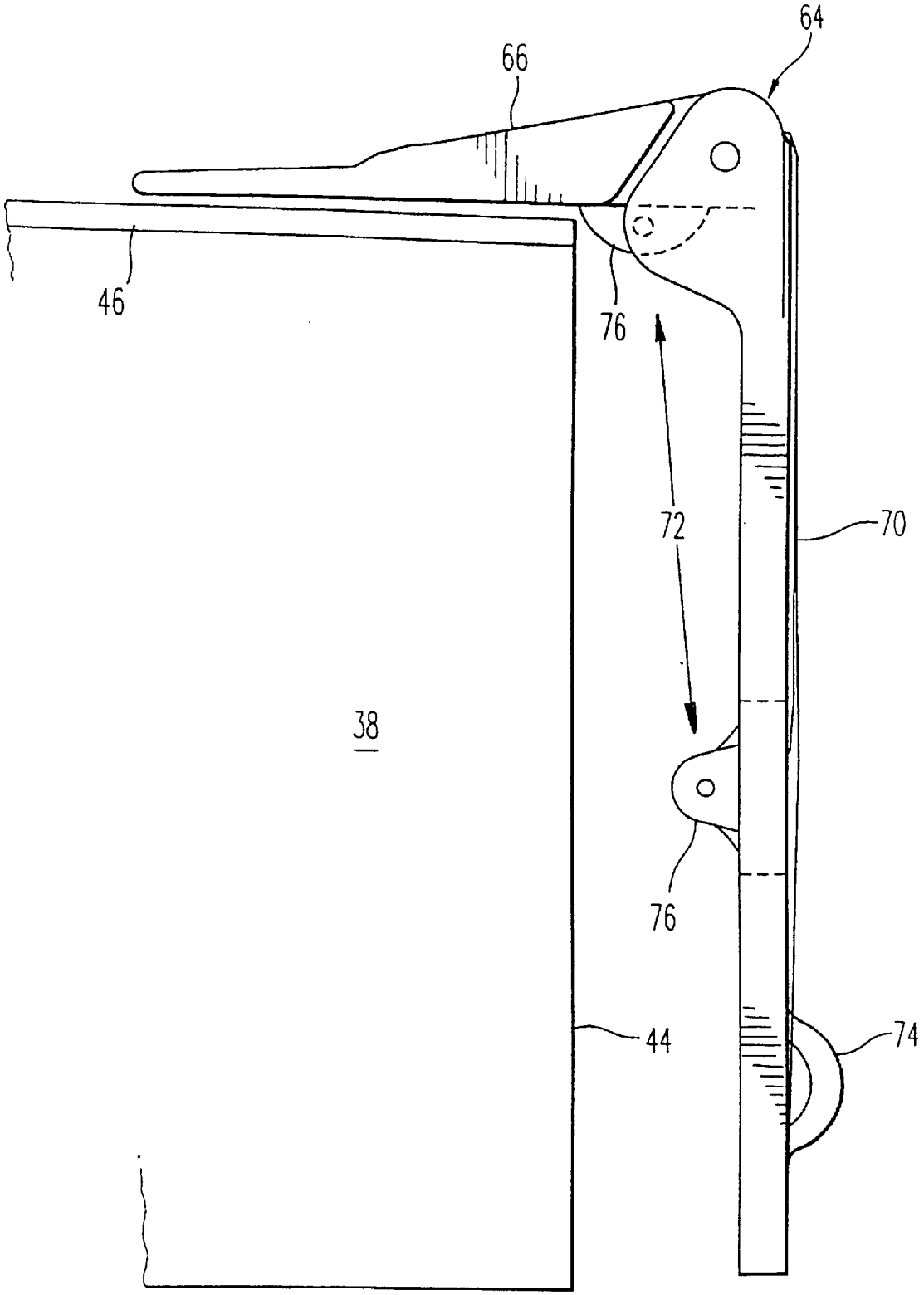
FIG. 7 is a partial side view of a propeller guard showing a side view of a trolling plate with springs removed.
Figure 8:
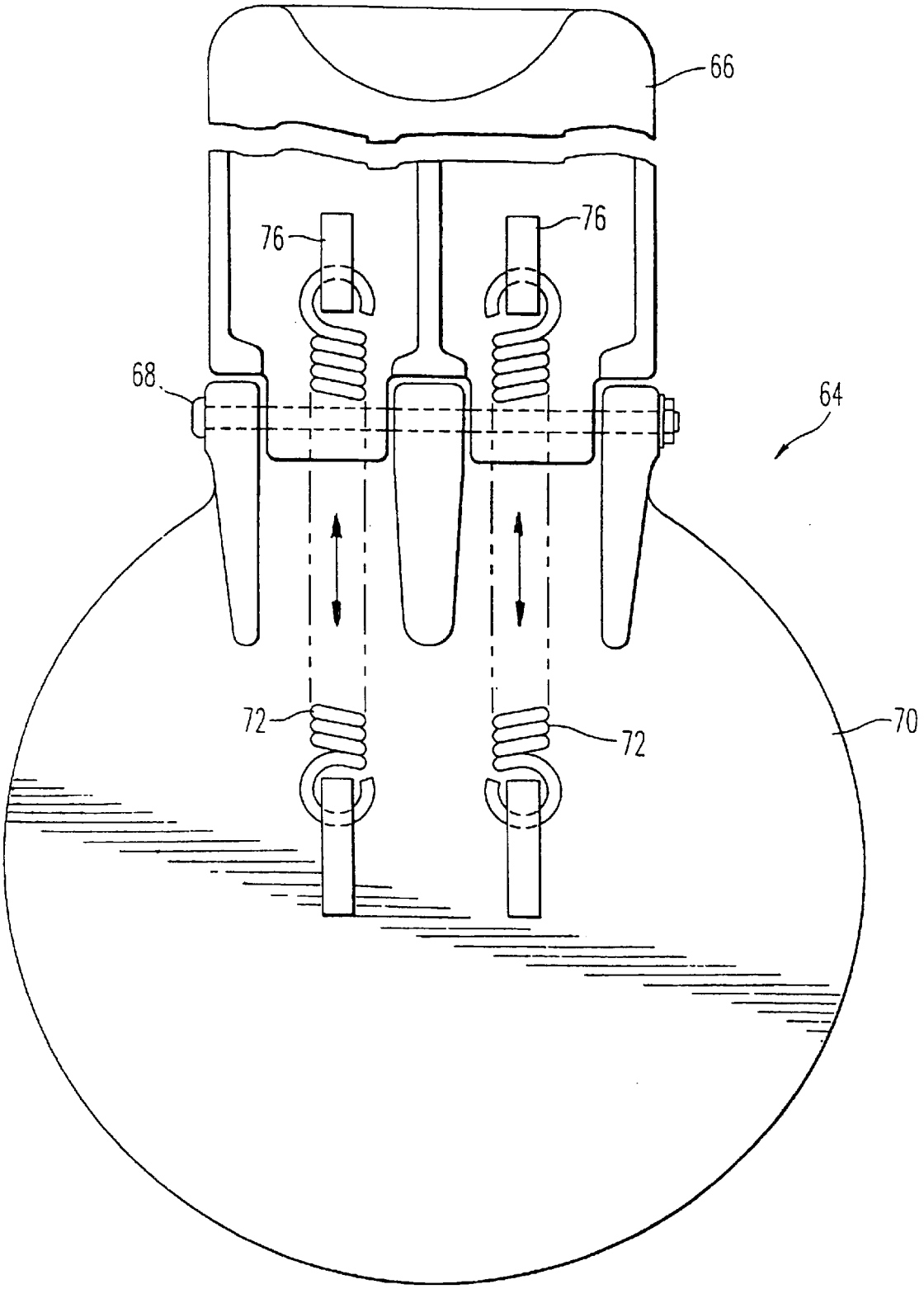
FIG. 8 is an underside view of the trolling plate of FIG. 7.

As shown in FIGS. 7 and 8, low speed performance of the guard 38 can be improved by mounting a trolling assembly 64 at the outlet 44 end of the guard 38. The assembly 64 provides the propeller with better trolling characteristics by diverting the backward thrust to allow the engine to operate at lower speeds at higher rpm within the better idling characteristics of the engine. The assembly 64 also improves safety by keeping arms and legs from reaching the propeller from the rear.

The assembly 64 includes a hinge plate 66 which is hinged with a hinge pin 68 with a flap 70 which is biased by springs 72 to extend at 90° from the hinge plate 66 and rotate to 0° at forward speeds in excess of trolling. The hinge plate 66 is mounted to the hydrofoil fin 46 by screws or the like and is typically removable. The hinge plate 66 extends rearward of the fin 46 so that flap 70 is a minimum of one inch front the outlet 44 to allow the propeller to be operated in reverse. The flap 70 includes on its outward side a lifting eye 74 which allows the flap to be tied in its upward position to maximize unobstructed flow and for extended travel in reverse. The face of the flap 70 should be shaped similar in size and shape to the outlet 44 of the thrust tube 40. Preferably, there are two springs 72 extending between separate spring eyes 76 with one mounted on the hinge plate 66 and the second on the flap 70.

I claim:

1. For a boat having a keel and an outboard motor which has a driveshaft extending within a driveshaft housing to extend below the boat's keel and the driveshaft housing including an anti-cavitation plate and skeg and mounted on such driveshaft a propeller with a hub, the improvement comprising a molded one piece guard having a thrust tube which is a cylindrical tube having an inside and outside diameter and having an inlet and outlet along a horizontal axis; a hydrofoil fin integral to the top of the tube and extending tangentially outward equally from the top of the tube with a span substantially greater than the outside diameter of the tube and including attaching means; and two securing plates extending spaced apart in parallel, upward from and integral to a tube extension extending, forward at the bottom of the tube from an imaginary vertical plane otherwise formed by the edge of the inlet of the tube and including attaching means and which means allows attachment with the inlet no more than an inch forward of the leading edge of the propeller blades.

2. The guard of claim 1 wherein the tube is about 6 inches in length.

3. The guard of claim 1 wherein the tube is about 9 inches in length.

4. The guard of claim 1 wherein the front of the fin includes a "U" shaped cutout.

5. For a boat having a keel and an outboard motor which has a driveshaft extending within a driveshaft housing to extend below the boat's keel and the driveshaft housing including an anti-cavitation plate and skeg and mounted on such driveshaft a propeller with a hub and having a cylindrical thrust tube having an inlet and outlet along a horizontal axis; a hydrofoil fin integral to the top of the tube and extending tangentially outward from the top of the tube and including attaching means to the driveshaft housing; the improvement comprising a trolling assembly which includes a hinge plate which is hinged with a hinge pin with a flap which is biased to extend at 90° from the hinge plate and rotate to 0° and having the hinge plate mounted to the hydrofoil fin and the hinge plate extending rearward of the fin so that the flap is a minimum of one inch from the outlet and the flap has a circular face similar in size to the outlet.

6. The guard of claim 1 including a trolling assembly which includes a hinge plate which is hinged with a hinge pin with a flap which is biased to extend at 90° from the hinge plate and rotate to 0° and having the hinge plate mounted to the hydrofoil fin and the hinge plate extending rearward of the fin so that the flap is a minimum of one inch from the outlet and the flap has a circular face similar in size to the outlet.

* * * * *